US006682244B2

(12) United States Patent
Gueret

(10) Patent No.: US 6,682,244 B2
(45) Date of Patent: Jan. 27, 2004

(54) DEVICES AND METHODS FOR DISPENSING

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/859,444

(22) Filed: May 18, 2001

(65) Prior Publication Data

US 2002/0021932 A1 Feb. 21, 2002

(30) Foreign Application Priority Data

May 19, 2000 (FR) ..... 00 06449

(51) Int. Cl.[7] ..... B05C 17/00
(52) U.S. Cl. ..... 401/208; 401/220
(58) Field of Search ..... 401/208, 219, 401/220, 191

(56) References Cited

U.S. PATENT DOCUMENTS

| | | | | | |
|---|---|---|---|---|---|
| 2,163,355 | A | * | 6/1939 | Sechrist | 401/208 |
| 3,039,132 | A | * | 6/1962 | Hambley | 401/220 |
| 3,095,598 | A | * | 7/1963 | Gonnella et al. | 401/220 |
| 3,103,689 | A | * | 9/1963 | Borisof | 401/2 |
| 4,342,522 | A | * | 8/1982 | Mackles | 401/214 |
| 4,368,184 | A | * | 1/1983 | Drucker et al. | 424/66 |
| 4,723,860 | A | * | 2/1988 | Giblin et al. | 401/208 |
| 5,213,431 | A | * | 5/1993 | Gentile et al. | 401/219 |
| 5,401,113 | A | | 3/1995 | Gueret | |
| 5,836,320 | A | * | 11/1998 | Gueret | 132/317 |
| 6,076,985 | A | | 6/2000 | Gueret | |

FOREIGN PATENT DOCUMENTS

| | | | |
|---|---|---|---|
| EP | 0 855 177 | | 7/1998 |
| EP | 0 933 039 | | 8/1999 |
| FR | 512263 | * | 3/1920 |
| FR | 2 701 364 | | 8/1994 |
| FR | 2 745 272 | | 8/1997 |
| WO | WO 97/31553 | | 9/1997 |
| WO | WO 99/01052 | | 1/1999 |

OTHER PUBLICATIONS

English translation of non–English language document FR 512 263, patented Oct. 1920.
English language Derwent Abstract of EP 0 933 039.

* cited by examiner

*Primary Examiner*—Gregory L. Huson
*Assistant Examiner*—Huyen Le
(74) *Attorney, Agent, or Firm*—Finnegan, Henderson, Farabow, Garrett & Dunner, LLP

(57) ABSTRACT

A device for dispensing comprises a reservoir containing a composition comprising particles containing at least one fluid, an application member having at least a portion removably disposed within the reservoir and configured to be loaded with the composition and a compacting member configured to exert pressure on at least the portion of the application member during removal of the portion of the application member from the reservoir.

148 Claims, 2 Drawing Sheets

DEVICES AND METHODS FOR DISPENSING

The present invention relates to a dispenser for dispensing a composition comprising particles containing at least one fluid. The composition may be in the form of a powder, such as that used, for example, in the make-up field and/or the field of skin and mucous membrane care, and in particular in the field of make-up products for the face and skin, such as eye-shadow, blusher, and face and body powder.

Certain powders, sometimes termed "liquid powders", may include a "dry" or pulverulent phase that may comprise a binder and may generally be based on pigments and/or nacres and/or fillers and/or flakes, and/or on mixtures thereof, and a phase that may act as a binding phase and contain, inside microcapsules, vesicles, microsponges, porous waxes or other suitable structure capable of storing a fluid, a fluid such as water, propylene glycol, oil, a gel or even an oil in water (O/W) or water in oil (W/O) emulsion, for example. These structures containing the fluid may be capable of releasing the fluid, optionally in response to sufficient pressure. Upon application of such a powder, which may occur by spreading and pressing the powder against the skin, for example via an applicator, the fluid contained in the vesicles or microcapsules is released, giving a pleasant cool sensation during application.

An example of such a structure capable of storing water is described in the context of a whitening powder forming the subject matter of EP-A-0 855 177. In that publication, the whitening powder contains, apart from the ingredients providing the whitening effect, from 0.1 to 7% by weight of trimethylsiloxylated silicic acid in the anhydrous form, having a specific surface area of at least 80 $M^2/g$ and a degree of hydrophobicity of at least 50%. The water retained by the silicic acid in anhydrous form is released by spreading and pressing the powder against the surface to be treated, so that the powder liquefies.

Such powders, especially when they are in a continuous aqueous phase, may moisten the skin and may prevent or limit a tautening or drying effect on the skin. The pigments may be well dispersed in them. The composition obtained may furthermore be relatively homogeneous and remain so for several hours even after application to the skin.

Furthermore, such compositions may have beneficial cosmetic properties. For example, they may stick to the skin sufficiently, but not excessively, and they may be very soft and easily applied. In addition, they may be prevented from either transferring or migrating into the folds of the skin.

A problem may arise with these powders in the way they are handled and applied, such as by means of an applicator. This is because with this type of powder, when dispensing the powder, the pressure exerted by the applicator on the product must not be too high, otherwise the fluid contained in the particles may be released prematurely. On the other hand, the pressure should be high enough to allow the product to be anchored to or compacted on the applicator. Furthermore, it may be difficult for the product to be dispensed in a metered amount.

Conventionally, such powders are packaged in a receptacle mounted above a screen through which the powder is made to pass. The dispensing may take place by means of an applicator, usually which may be in the form of a powder puff which is brought into engagement with the powder on the screen so as to dispense the powder. Because of the difficulty of controlling the degree of pressure exerted on the powder via the applicator, it may happen that the powder is compacted on the screen, clogging up the pores of the screen. In addition, the pulverulent phase contained in the powder may have a tendency to "fly off" during application due to an insufficient anchoring of the pulverent phase on the application member.

When such a composition is dispensed under certain optional conditions, the particles containing the fluid may agglomerate with the pulverulent compounds to form a kind of heterogeneous and unstable paste, which may be difficult to use as a make-up product.

It is an optional object of the invention to provide a device for dispensing and applying a composition at least partly formed from particles containing a fluid and to optionally solve, completely or partly, the problems discussed above with reference to conventional devices.

In particular, it is an optional object of the invention to provide such an assembly which allows easy, metered and homogeneous application of such a product, which may avoid the phenomena of compacting or of premature fluid release.

Yet other optional objects will become apparent from the detailed description which follows.

The devices and methods of dispensing and applying described herein may optionally solve some or all of the problems discussed above with reference to conventional applicators. It should be understood that the invention could be practiced without performing one or more of the optional objects and/or advantages described above. Certain other optional aspects of the invention will become apparent from the detailed description which follows.

When such a composition is dispensed by means of a device having an optional arrangement, such a composition may be handled and, in particular, dispensed and spread, much more satisfactorily.

According to a first optional aspect of the invention, a device is provided for the dispensing and application of a composition, for example a cosmetic composition, the composition being disposed inside a reservoir and being at least partly formed from particles containing at least one fluid. The device may comprise an applicator comprising an application member and a gripping element. At least a portion of the application member may be configured to be loaded with the composition. The device further may comprise a compacting member and be configured in such a way that, during a movement of the applicator with respect to the reservoir, the portion of the application member loaded with the composition contacts at least a portion of the compacting member and pressure exerted between the portion of the application member and the portion of the compacting member promotes anchoring of the composition on at least the portion of the application member.

According to another optional aspect of the invention, a device for dispensing a composition comprising particles containing at least one fluid comprises a reservoir containing a composition comprising particles containing at least one fluid, an application member having at least a portion configured to be loaded with the composition, and a compacting member configured to permit passage therethrough of at least the portion of the application member configured to be loaded with the composition, the compacting member being configured to exert pressure on at least the portion of the application member.

Yet another optional aspect of the invention relates a device for dispensing a composition comprising particles containing at least one fluid, the device comprising a reservoir containing a composition comprising particles containing at least one fluid, an application member having at least a portion removably disposed within the reservoir and configured to be loaded with the composition, and a compacting member configured to exert pressure on at least the portion of the application member during removal of the portion of the application member from the reservoir.

Optionally, pressure exerted on the portion of the application member may be sufficient to anchor or compact the composition on the application member. Also optionally, pressure exerted on the portion of the application member may be sufficiently low so as to at least substantially limit release of the at least one fluid contained in the particles.

The device according to optional aspects of the invention may further comprise a composition comprising a solid material, which may optionally be a pulverent material mixed with the particles containing at least one fluid.

According to another optional aspect, the particles containing at least one fluid are particles having a hollow or porous structure, which may be capable of storing a certain amount of the fluid and of releasing it, in response to sufficient pressure which may correspond substantially to the pressure resulting from applying the composition to the surface to be treated. In other words, in the container which contains them (possibly as a mixture with a pulverulent phase), the two phases forming the particles ("solid" phase forming the vehicle and the fluid phase contained within the "solid" phase) may remain separate, one phase being contained in the other. On the other hand, in response to sufficient pressure, the liquid may be forced out of the structure which contains it and may be released on the surface to which the composition may be applied. The liquid thus released may be brought into contact, where appropriate, with a pulverulent phase in order to promote its spreading over and retention on the skin.

It is contemplated to be within the scope of the invention to provide a composition in the reservoir formed entirely of the particles containing the at least one fluid. Moreover, the particles may contain more than one fluid. It also is contemplated that the composition may comprise at least one other fluid outside of the particles containing the at least one fluid. Overall, numerous compositions may be contemplated for use with optional aspects of the invention, each comprising particles containing at least one fluid.

The fluid optionally may be contained within vesicles, microcapsules or nanocapsules, microsponges, microspheres or any other suitable porous structure. The fluid optionally may be water, a gel, an oil, polypropylene glycol or an O/W or W/O emulsion.

Optionally, the particles containing the at least one fluid represent from approximately 1% to approximately 50% by weight of the composition, and may optionally represent from approximately 2% to approximately 30% by weight of the composition, and may optionally represent from approximately 5% to approximately 20% by weight of the composition.

Hereinafter, for mere convenience, the particles containing the at least one fluid are sometimes referred to as the "liquid phase", even though they include at least some solid or semi-solid portion that contains the fluid, and even though the fluid is not necessarily a liquid. The liquid phase of the composition, where appropriate, may help the pulverulent phase, if any, to stick to the surface to be treated and also may help it to be spread on the surface. The liquid phase also may be used as a vehicle for at least one active ingredient, such as for skincare. It may furthermore create a cool effect on the skin.

The movement of the application member either optionally passing through the compacting member or moving with respect to the reservoir so as to contact with at least a portion of the compacting member, for example, during removal of a portion of the application member from the reservoir, may cause pressure applied by the compacting member on the application member to remain substantially the same throughout the lifetime of the system. The pressure may be selected so as to be sufficiently high to allow adequate anchoring or compacting of the composition on the application member and sufficiently low to at least substantially limit premature release of the fluid in the particles. Furthermore, the pressure exerted on the portion of the application member by the portion of the compacting member optionally may result in a homogeneous spreading of the composition, which homogeneous spreading may help the product to be spread over the surface to be treated, such as the skin, for example. half of the height of the container. Such a volume may make it possible, for example, by shaking the device, to homogenize the product contained in the reservoir, especially when the composition comprises particles having differing densities. This shaking may possibly bring the composition into contact with at least a portion of the application member, if the latter has not been "immersed" in the composition, to load the portion of the application member.

Optionally, in a position in which the applicator is mounted on the container, the application member may be placed between the free surface of the composition and the compacting member, and the loading of the portion of the application member with the composition optionally may take place by shaking the device. Compacting of the composition in the reservoir by the application member may optionally be avoided.

According to an optional embodiment, the application member may have a circular cross-section and may be mounted so as to rotate inside a casing associated with the reservoir. The casing may optionally comprise the compacting member, and have a first opening in flow communication with the reservoir and a second opening in flow communication with an exterior of the reservoir. The application member may be configured to move from a first position to a second position, wherein in the first position, a portion of the application member loaded with composition is in flow communication with the reservoir via the first opening and in the second position, the portion of the application member is exposed to the exterior of the reservoir via the second opening so as to allow application of the composition loaded on the portion of the application member. Optionally, the first and second openings may be separated by at least one portion of the compacting member and movement of the loaded portion of the application member from the first position to the second position causes the loaded portion of the application member to pass through the compacting member.

Optionally, movement of the application member from the first position to the second position takes place by a rotation, and the rotation optionally may be about a pin oriented substantially perpendicular to the substantially circular cross-section of the application member.

The applicator may be actuated by the user from outside the reservoir, and optionally the actuating device may include at least one thumbwheel fixed at one end of the rotation pin and placed at least partially outside the casing.

According to another optional embodiment, the compacting member includes an element formed from at least one foam material. The compacting member may be mounted proximate a top portion of the reservoir. Optionally, the compacting member may define a passage through which the portion of the application member is configured to pass. The passage may be in the form of a slot.

The application member may be provided on a first end of a wand opposite to a second end of the wand which may be provided with a gripping element for holding the applicator. The gripping element may optionally be capable of sealing the opening of the reservoir when the applicator is mounted on the reservoir.

Optionally, at least one or each edge defining the slot or passage of the compacting member may be substantially contiguous.

In a position in which the applicator is optionally mounted on the container, the application member may lie between the compacting member and a bottom of the container, for example between the compacting member and the free surface of the composition in the reservoir. One portion of the wand may be placed in the passage or slot of the compacting member and may be configured so that the wand portion does not substantially compress the foam element.

The foam material of the compacting member optionally may be a foam at least partly formed from open or semi-open cells, for example a foam of an elastomer, such as a polyurethane or polyether elastomer, for example, the foam may have at least 5% of its cells open and the cells may have a diameter ranging from approximately 5 $\mu$m to approximately 3 mm. The height of the foam block may range from approximately 1.5 mm to approximately 80 mm.

The foam block optionally may be stiffened around its periphery and over at least part of its height, which may prevent it from being compressed when inserting the applicator into the container.

According to optional aspects, the compacting member may be formed by joining together two solid half-cylinders of foam, held against each other by the neck of the container and defining between them a slot which may open up for passage of the application element. Again optionally, the compacting member may be produced by winding a strip of foam on itself, defining a central recess for passage of the application element. The compacting member may also be made by superposing several washers made of different types of foam, such as foams having cell densities which increase on approaching the outlet of the container. In addition, the compacting member may include an axial recess for passage of the application element passing through the assembly.

The compacting member may be retained in many optional ways in the container. For example, the foam block may simply be stuck or welded around its periphery to the wall of the container.

Optionally, the device comprises an application member with a disk-like configuration.

The invention also optionally relates to use of the devices according to various optional aspects of the invention. One optional method of using device comprises loading at least the portion of the application member with the composition contained in the reservoir, moving the application member with respect to the reservoir so as to place at least the loaded portion in contact with at least a portion of the compacting member, and placing at least the loaded portion of the application member in contact with a surface to apply the composition to the surface.

According to another optional aspect of the invention, a method of dispensing a composition comprising particles containing at least one fluid comprises providing an application member, a compacting member, and a reservoir containing a composition comprising particles containing at least one fluid, loading at least a portion of the application member with the composition, passing at least the loaded portion of the application member through the compacting member, and exerting pressure on at least the loaded portion of the application member with the compacting member.

In yet another optional aspect, a method of dispensing a composition comprising particles containing at least one fluid comprises providing a reservoir containing a composition comprising particles containing at least one fluid, an application member having at least a portion removably disposed in the reservoir and a compacting member, loading at least the portion of the application member with the composition, removing at least the loaded portion of the application member from the reservoir, and exerting pressure on the loaded portion of the application member with the compacting member during removal of the portion of the application member from the reservoir.

Optionally, exerting pressure may include exerting pressure sufficient to compact or anchor the composition on the application member. Also optionally, exerting pressure may include exerting pressure sufficiently low so as to at least substantially limit release of the fluid from the particles.

In another optional aspect, the method comprises placing at least the loaded portion of the application member in contact with a surface to apply the composition to the surface. The placing may optionally include exerting pressure on at least the loaded portion of the application member sufficient to release the at least one fluid from the particles. The placing may optionally also include placing at least the portion of the application member in contact with one of skin, nails, and hair.

According to another optional aspect, the method comprises loading the portion of the application member by shaking the reservoir containing the composition.

In yet another optional aspect, the passing the application member through the compacting member or the moving of the application member or the removing of the application member includes one of rotating and translating the application member. Optionally, the application member may have a disk-like configuration and may be rotated. A direction of relative movement between the application member and compacting member optionally may be in a plane chosen from a plane of an application surface of the application member and a plane tangential to the application surface.

According to an optional aspect, the removing the application member from the reservoir includes passing the portion of the application member through at least a portion of the compacting member. The passing may optionally include passing the application member through a passage defined by the compacting member.

According to various optional aspects of the invention, the composition to be dispensed and applied may comprise a pulverulent phase, as a mixture with the liquid phase, and may be formed from pigments and/or nacres and/or fillers and/or flakes normally used in cosmetic compositions, and/or mixtures thereof. The particles forming the pulverulent phase may furthermore be coated with a binder.

The term "pigments" should be understood to mean white or coloured, mineral or organic, particles which are insoluble in the medium and intended to colour and/or opacify the composition.

The pigments may be white or coloured, mineral and/or organic, and of a conventional or nanometric size. Mention may be made, among mineral pigments and nanopigments, of titanium, zirconium or cerium dioxides, zinc, iron or chromium oxides, nanotitanium particles, nanozinc particles and ferric blue. Among organic pigments, mention may be made of carbon black and lacquers such as calcium, barium, aluminum or zirconium salts and acid dyes, such as halo-acid, azo or anthraquinone dyes.

The pigments may be coated with silicone compounds, such as polydimethylsiloxanes, and/or with polymers, such as polyethylenes. For example, mention may be made of the pigments SA or SI sold by Maprecos.

The term "fillers" should optionally be understood to mean colourless or white, mineral or synthetic, lamellar or non-lamellar particles intended to provide body or stiffness to the composition and/or to provide softness, mattness and uniformity to the make-up.

The fillers optionally may be mineral or synthetic, lamellar or nonlamellar fillers. Mention may be made of talc, mica, silica, kaolin, nylon, poly-β-alanine and polyethylene powders, Teflon, lauryl-lysine, starch, boron nitride, bismuth oxychloride, tetrafluoroethylene polymer powders, polymethyl methacrylate powders, polyurethane powders, polystyrene powders, polyester powders, synthetic hollow microspheres, such as EXPANCEL (from Nobel Industrie), microsponges, such as POLYTRAP (from Dow Corning) and microbeads of silicone resin TOSPEARLS from Toshiba, for example), zinc and titanium oxides, zirconium or cerium oxides, precipitated calcium carbonate, magnesium carbonate and hydrocarbonate, hydroxyapatite, hollow silica microspheres (SILICA BEADS from Maprecos), glass or ceramic microcapsules and metal soaps derived from carboxylic organic acids having from 8 to 22 carbon atoms, preferably from 12 to 18 carbon atoms, for example zinc, magnesium or lithium stearate, zinc laurate and magnesium myristate.

The term "nacres" should be understood to mean pearlescent particles which reflect light. Among nacres that can be envisaged for optional use with the invention, mention may be made of natural nacre, mica covered with titanium oxide, iron oxide, natural pigment or bismuth oxychloride, and coloured titanium-mica.

The compositions according to optional aspects of the invention may also include flakes. Furthermore, the powder for use with an optional aspect the invention may include any additive normally used in the field relating to antioxidants, essential oils, preservatives, neutralizing agents, W/O or O/W surfactants, vitamins and anti-wrinkle active agents.

The fluid contained in the liquid phase optionally may be in the form of water, polypropylene glycol, oils, especially essential oils, gel, especially cubic gel particles, or a water-in-oil (W/O) or oil-in-water (O/W) emulsion.

The fluid optionally may be contained in vesicles or microcapsules, the walls of which may be made of epoxy, polyethylene, gelatin or polyester, or in microsponges or microspheres. The fluid optionally may also be contained in porous waxes such as polyacrylates.

The fluid, for example when it is water, optionally may be contained in an anhydrous structure of the type described in EP-A-0 855 177. Again by way of optional example, the "liquid" phase may comprise an aqueous dispersion of vesicles including a membrane of a lipid phase encapsulating an aqueous phase. The vesicles that may be used according to optional embodiments of the present invention also may be provided with a lamellar, liquid-crystal coating.

The composition optionally may contain at least one active agent. Such an active agent may be hydrophilic, lipophilic or a combination of the two.

Among the various active agents that may be incorporated, there may for example be the following:

antioxidants or free-radical scavengers such as proteins and enzymes, lactoperoxydase and lactoferrin, peptides and their derivatives, sequestrants, flavonoids, chlorophylline, ethoxyquine, guanosine, tocopherols and their derivatives, ascorbyl palmitate and β-carotene, vitamin E and its derivatives, vitamin C and its derivatives and vitamin A and its derivatives;

hydrating agents or humectants such as hyaluronic acid and the sodium salt thereof; β-glycerophosphate, glycerol, sorbitol and panthenol;

UV screening agents such as the products marketed under the names "EUSOLEX 232®" by Merck, "PARSOL 1789®" and "PARSOL MCX®" by Givaudan-Roure, "MEXORYL SX®" by Chimex and "UVINUL T150®" by BASF;

keratolytics such as proteolytic enzymes, salicylic acid and derivatives thereof, such as 5-n-dodecanoyl salicylic acid and retinoic acid and derivatives thereof;

tanning accelerators such as caffeine and tyrosine derivatives such as glucose tyrosinate and the disodium salt of N-L-malyltyrosine;

depigmenting agents such as kojic acid, glycolic acid, vitamin C and especially magnesium ascrobyl phosphate, and arbutin and derivatives thereof;

natural dyes such as dyestuffs extracted from plants, such as chlorophyllin and β-carotene, or extracted from animals, such as cochineal carmine, and caramel;

self-tanning agents such as dihydroxyacetone and indoles;

lipid regulators such as γ-orizanol, extract of *Centella asiatica* containing genin and asiatic acid, caffeine, and theophylline;

anti-ageing and anti-wrinkle agents such as hydroxy acids like glycolic acid, n-octanoyl salicylic acid, retinol and derivatives thereof, such as retinol acetate, palmitate and propionate, and retinoids;

anti-inflammatories and cicatrisants such as 18-β-glycyrrhetinic acids and salts thereof, especially the ammonium salts thereof, α-bisabolol, corticoids, extract of *Centella asiatica,* and aloe vera;

bactericides and fungicides such as benzalkoniurn chloride, chlorhexidine, hexetidine and hexamidine;

insecticides such as diethyltoluamide and dimethyltoluamide;

deodorants such as hexachlorophene and the triclosan product marketed under the name "IRGASAN DP 300®" by Ciba-Geigy;

skin conditioners such as cationic polymers and cations.

Optionally, the composition comprises a cosmetic product.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention and, together with the description, serve to explain some principles of the invention. In the drawings, FIG. 1 is a perspective view of a dispensing assembly according to an optional embodiment of the invention;

Figure 2:
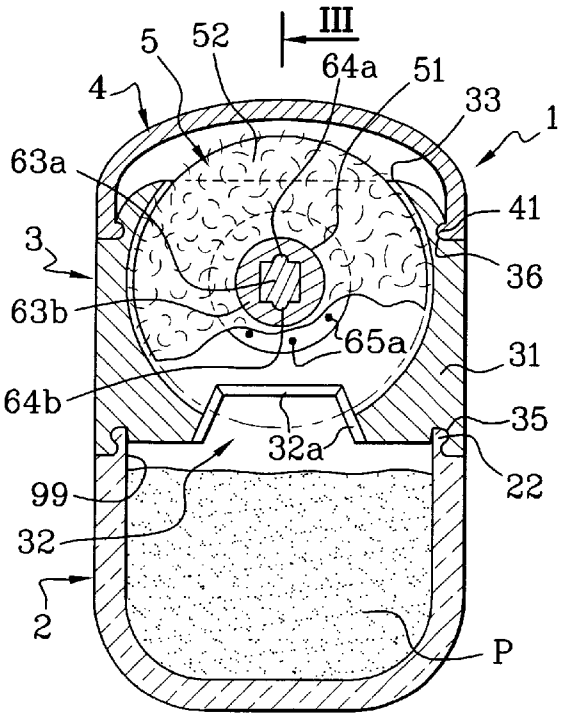
FIG. 2 is a cross-sectional view of the dispensing assembly of FIG. 1.
Figure 3:
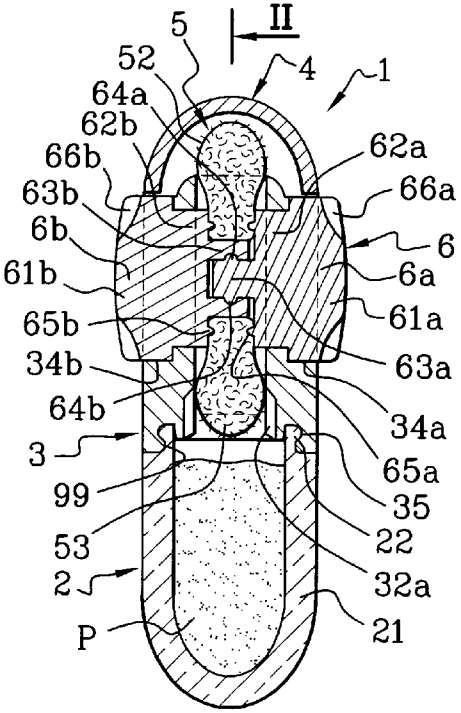
FIG. 3 is a side cross-sectional view of the dispensing assembly of FIG. 1 taken from line III—III in FIG. 2.

The dispenser and applicator device shown in FIGS. 2 to 3 is denoted in its entirety by the reference numeral 1. It is composed of a reservoir 2, a casing 3 and a removable lid 4. The casing 3 carries an applicator disc 5, rotatable around a pin 6. The reservoir 2 may be a cylinder of almost rectangular cross-section bounded by two substantially plane parallel side walls 21 and defining an opening 99 in its upper part. The edge of the reservoir may be provided with a snap-fastening device 22, which may engage with a corresponding device 35 on the casing 3. The reservoir may contain a powder P for applying make-up to the cheeks, of the type described above. In the optional embodiment shown, the liquid phase comprises wax microcapsules containing water.

The casing 3 may have a shell 31, the outer side walls of which lie along the extension of those of the reservoir 2. Provided in this casing 3 may be a cylindrical space, having a circular cross section coaxial with the applicator disc 5 and with the pin 6 and having dimensions allowing it to closely match the shape of the applicator disc 5. Provided on the lower edge of the shell 31 of the casing may be an inner opening 32 bringing the reservoir 2 into flow communication with the inner cylindrical space of the shell 31 of the casing 3. This opening 32 may have indents made in the plane side walls of the shell 31 that are trapezoidal in shape. Over the entire perimeter of the opening 32, the edge 32*a* may have the shape of a bevel inclined from the outside inward. In its upper part, the casing 3 may have an outer opening 33 of rectangular shape. Provided in the shell 31 may be two circular windows 34*a* and 34*b* for the passage and fastening of the rotation pin 6 of the applicator disc 5, as explained below. Inside the wall of the shell 31, these windows 34*a,* 34*b* may include two sections of different diameters, separated by a shoulder, the smaller-diameter section emerging in the cylindrical space of circular cross-section. Provided on the upper part of the casing, around the outer opening 33, may be a mechanism for fastening the lid 4. This device may comprise a snap-fastening mechanism 36 which engages with a corresponding mechanism 41 on the lid 4.

Figure 1:
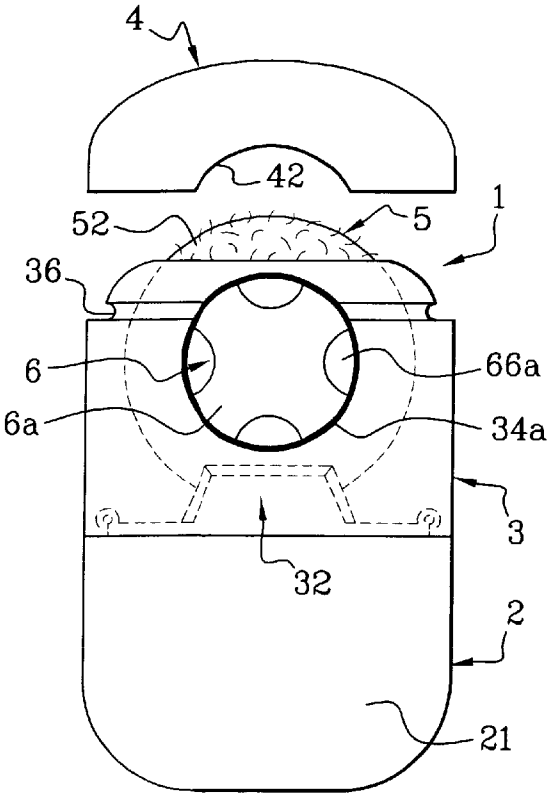

In the optional embodiment shown in FIGS. 1 to 3, the applicator disc 5 is entirely made of a flocked soft foam. It is provided at its centre with a circular opening 51 for passage of the pin 6. The disc 5 may have dimensions such that, when fit into the casing 3, a segment 52 projects from the casing 3 through the opening 33 and a segment 53 of the disc is located in the opening 32 in line with the trapezoidal indents.

The pin 6 may include two elements 6*a* and 6*b* which fit together, one in the other. Each of these elements may be formed from three successive parts of decreasing cross-section, namely a thumbwheel 61*a,* 61*b* of circular cross-section, a flange 62*a,* 62*b* of circular cross-section and a shaft 63*a,* 63*b*. The shaft 63*a* of the element 6*a* may be solid and have, in cross-section, a square shape. It may fit into the hollow shaft 63*b* which may have a cavity with a square cross-section corresponding to that of the shaft 63*a*. The shaft 63*a* may be fastened in the shaft 63*b* by a double snap-fastening system comprising a rib 64*a* and a groove 64*b*. The flanges 62*a* and 62*b* may carry axial barbs 65*a* and 65*b* which penetrate the soft foam constituting the disc 5 and prevent any relative rotation of the disc 5 with respect to the pin 6 when the assembly is fitted. The flanges 62*a* and 62*b* may be partially located in the smaller-diameter cross-section of the windows 34*a* and 34*b*. The thumbwheels 61*a* and 61*b* may be partially located outside the windows 34*a,* 34*b* in the larger-diameter cross-section of the windows and bear on the shoulder between the two sections of different diameter of the windows 34*a* and 34*b*. Thus, when the two elements 6*a,* 6*b* have been fitted together, the pin 6 may be positioned and retained axially. The thumbwheels 61*a* and 61*b* may be provided on the outside with four notches 66*a* facilitating the manual action by the user on each of the thumbwheels.

The lid 4 may be fastened to the upper part of the casing 3 so as to protect the segment 52 of the applicator 5 emerging from the opening 33 in the casing 3. The lid 4 may have, on its faces which lie in the extension of the parallel walls 21 of the reservoir 2, circularly arcuate indents 42 which the thumbwheels 61*a,* 61*b* may occupy when the lid 4 is in the closed position.

The device 1 optionally operates in the following manner. When the user wishes to dispense, for example, a powder P contained in the reservoir 2, the user removes the lid and turns the device 1 upside down, or shakes it vigorously, in order for the powder P to come into contact with the portion 53 of the disk 5. Next, the user rotates one of the thumbwheels 61*a* or 61*b* by approximately one-half of a turn, in one direction or the other, in order for the portion 53 of the disk, now loaded with the composition, to take the place corresponding to the portion 52 previously emerging from the opening 33. During the rotation, the powder may be tamped by the inclined edges 32*a,* between which the disk is driven, and then by the inner surface of the shell 31. The composition thus may be compacted or anchored on the applicator 5 and distributed homogeneously over the loaded portion 53. Optionally, a small amount of liquid, during this compacting operation, may become released on the applicator. In the end, the pulverulent phase may be substantially prevented from flying off the applicator. To apply the powder, the user may use the loaded portion 53 projecting from the casing 3 as an applicator, for example, by placing the portion 53 in contact with a surface.

Optionally, during application, by pressing the loaded portion 53 of the applicator against the skin, the liquid contained in the wax microcapsules may be released and mix with the pulverulent phase contained in the composition. This may make the skin feel cool and may help the powder to be spread over the skin and retained thereon.

By virtue of the elasticity of the periphery of the foam disk 5, contact between the disk 5 and the edge of the opening 32 may be sealed sufficiently to at least substantially reduce the risk of the powder escaping from the container during storage or when the assembly is turned upside down in order to bring the product into contact with the portion 53 of the disk 5.

Figure 4:
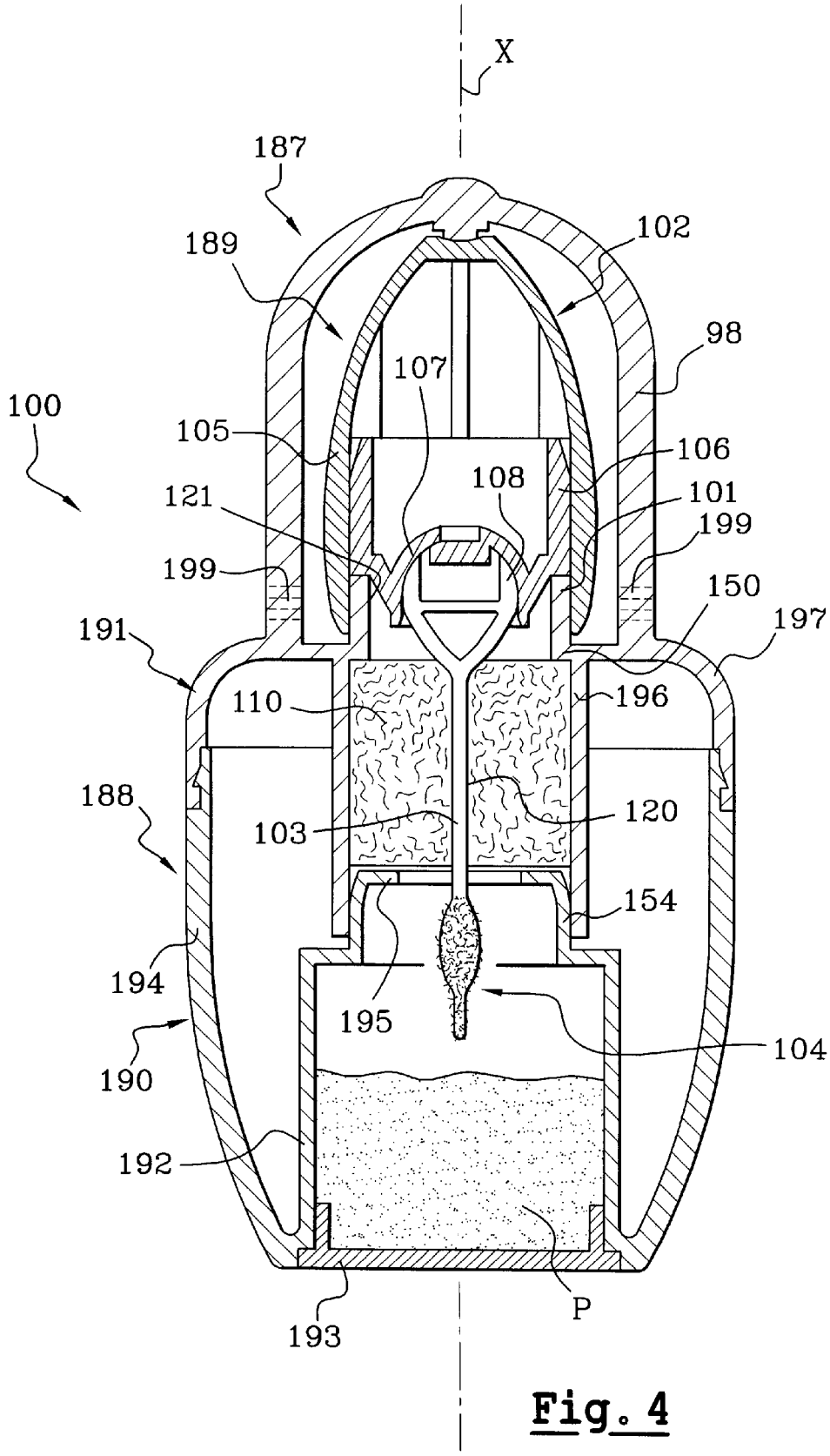
FIG. 4 is a cross-sectional view of a dispensing assembly according to another optional embodiment of the invention.

FIG. 4 shows a device 100 according to another optional embodiment of the invention. This device, having an axis X, comprises a reservoir 188 and an applicator 189. The reservoir 188 may be formed by joining a lower part 190 to an upper part 191. The lower part 190 may have a central tubular wall 192 closed at the bottom by an attached bottom piece 193 and may have a neck 154. The neck 154 may terminate in a rim 195 forming, radially, an inward projection.

Optionally, a powder P may be contained inside the tubular wall 192 and its free surface may lie approximately half way up the tubular wall 192. The pulverulent phase may comprise pigments and fillers for make-up for the lips. The liquid phase may be based on polypropylene glycol retained in wax microcapsules which may be configured to melt at relatively low temperature.

The upper wall 191 of the container 188 may have a central tubular wall 196 extended radially outwards, near its upper end, by an external skirt 197 which may be rounded downwards. The external skirt 194 of the lower part 190 may snap-fasten onto the internal surface of the external skirt 197. The tubular central wall 196 may then seal against the neck 154 of the tubular part 192.

An arch 98, which may be molded as a single piece with the upper part 191 of the reservoir 188, may be hinged to the external skirt 197 by means of bridges of material 199 forming hinges. The tubular central wall 196 may have, near its connection to the external skirt 197, a step 150 toward the inside, extended upward by a neck 101 defining an opening 121. The applicator 189 may have a gripping member 102 which may be attached to an end of a wand, or stem, 103. The stem may be provided with an application member 104 at its end opposite the end on which the gripping member 102 is disposed. The application member 104 may include an elastomer, of ovoid longitudinal section, and may have a shape narrowing down towards its free end. The application member 104 may be covered with a flocking over at least a portion of its surface. The gripping member 102 may be formed by the assembly of an external body 105, having an ogival shape and being open at its lower end, and of an internal part 106 fitted into the external body 105 and having a hollow recess 107 in which a spherical head 108 formed at the upper end of the wand 103 is retained, so as to constitute a ball joint.

In a closed position of the reservoir 188, the external body 105 of the gripping member 102 may fit onto the neck 101. Sealing may be achieved by the internal part 106 fitting tightly against the upper end face of the neck 101. The wand 103 of the applicator 189 may widen out at its lower end in order to form a housing used for fastening the application member 104, comprising, in this optional example, a felt tip.

A compacting member optionally may be in the form of a block of polyurethane foam 110 housed in the central tubular wall 196 and may be retained axially at its lower end by the internal rim 195 and at its upper end by the step 100. An axial passage 120 may pass through the foam block.

During application, the user may shake the device 100, so as to bring the powder P into contact with the application member 104, located at a distance from the free surface of the powder. The composition may be deposited both on at least a portion of the application member 104 and on the lower wall of the foam block 110. By removing the applicator 189 from the reservoir 188, the application member 104 may be made to pass through the foam block 110, via the passage 120, along a path approximately parallel to the axis X of the device. This being so, the powder present on the application member 104 may be compacted (e.g., pressed) between the surface of the application member 104 and the foam block 110, which may improve the retention of the powder on the application member. Furthermore, when removing the application member 104 via the passage 120 in the foam block 110, the lower wall of the foam block 110 may be entrained by the application member 104 and partly rise toward the inside of the foam block 110. This may transfer the powder present on the lower face of the foam block 110 onto the application member 104.

When the application member 104 has been removed from the reservoir 188, the powder may be firmly anchored on the application member and may be prevented from flying off. During application to the skin, the pressure exerted by the application member on the skin may release the liquid contained in the wax microcapsules, which liquid may create a pleasant cool and soft sensation and may help the powder to be spread over the skin and to be properly retained thereon.

Preferably, the compositions according to optional aspects of the invention are cosmetic, dermatological, or pharmaceutical compositions used for treating the hair, the skin, or the nails. However, in its broadest aspects, the present invention could be used to store and dispense many other types of flowable substances. For example, the dispenser may be used to dispense a variety of products, such as cleaning solutions, polishes, clothing dyes, or the like. Furthermore, sizes of various structural parts and materials used to make these parts are illustrative and exemplary only and one of ordinary skill in the art would recognize that these sizes and materials can be changed as necessary to produce different effects or desired characteristics of the dispensing assembly.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for dispensing a composition, comprising:

a reservoir containing a composition comprising particles containing at least one fluid;

an applicator comprising an application member, at least a portion of the application member being configured to be loaded with the composition; and a compacting member associated with the reservoir, wherein said device is configured such that, during a movement of the applicator with respect to the reservoir, the portion of the application member loaded with the composition contacts at least a portion of the compacting member and pressure exerted between the portion of the application member and the portion of the compacting member promotes anchoring of the composition on at least the portion of the application member.

2. The device of claim 1, wherein the composition further comprises a pulverulent phase mixed with the particles containing at least one fluid.

3. The device of claim 2, wherein the pulverulent phase is chosen from pigments, nacres, fillers, flakes, and mixtures thereof.

4. The device of claim 3, wherein the pigments are chosen from titanium dioxide, zirconium dioxide, cerium dioxide, zinc oxide, iron oxide, chromium oxide, nanotitanium particles, nanozinc particles, ferric blue, carbon black, lacquers, acid dyes, and pigments coated with silicone compounds.

5. The device of claim 4, wherein the lacquers are chosen from calcium salts, barium salts, aluminium salts, and zirconium salts.

6. The device of claim 4, wherein the acid dyes are chosen from halo-acid dyes, azo dyes, and anthraquinone dyes.

7. The device of claim 4, wherein the silicone compounds are chosen from polydimethylsiloxanes and polymers.

8. The device of claim 3, wherein the fillers are chosen from talc, mica, silica, kaolin, nylon, poly-β-alanine and polyethylene powders, Teflon, lauryl-lysine, starch, boron nitride, bismuth oxychloride, tetrafluoroethylene polymer powders, polymethyl methacrylate powders, polyurethane powders, polystyrene powders, polyester powders, synthetic hollow microspheres, microsponges and microbeads of silicone resin, zinc oxides, titanium oxides, zirconium oxides, cerium oxides, precipitated calcium carbonate, magnesium carbonate, magnesium hydrocarbonate, hydroxyapatite, hollow silica microspheres, glass microcapsules, ceramic microcapsules, and metal soaps derived from carboxylic organic acids having from 8 to 22 carbon atoms.

9. The device of claim 1, wherein the reservoir defines an opening and wherein the compacting member is mounted proximate the opening.

10. The device of claim 1, wherein the movement is chosen from a rotational movement and a translational movement.

11. The device of claim 10, wherein the movement is a rotational movement about a pin mounted on the device.

12. The device of claim 1, wherein the application member comprises flocking on at least part of a surface of the application member.

13. The device of claim 1, wherein at least part of the application member is made of a material chosen from an open-cell foam, a semi-open-cell foam, a thermoplastic elastomer, a cured elastomer, a sintered material, and a felt.

14. The device of claim 13, wherein the material is chosen from a polyester elastomer, a polyethylene elastomer, and a polyvinyl chloride elastomer.

15. The device of claim 13, wherein the material is chosen from a metal sintered material and a ceramic sintered material.

16. The device of claim 1, wherein a volume of air is disposed between a free surface of the composition in the reservoir and the compacting member.

17. The device of claim 1, wherein the applicator is configured to be mounted on the reservoir so that the application member is disposed between a free surface of the composition in the reservoir and the compacting member.

18. The device of claim 1, wherein the application member is configured to be loaded with the composition by shaking the device.

19. The device of claim 1, wherein the application member has a substantially circular cross-section and is mounted so as to rotate inside a casing associated with the reservoir.

20. The device of claim 19, wherein the casing comprises the compacting member, the casing having a first opening in flow communication with the reservoir and a second opening in flow communication with an exterior of the reservoir.

21. The device of claim 20, wherein the application member is configured to move from a first position to a second position and wherein, in the first position, a portion of the application member loaded with composition is in flow communication with the reservoir via the first opening and in the second position, the portion of the application member is exposed to the exterior of the reservoir via the second opening so as to allow application of the composition loaded on the portion of the application member.

22. The device of claim 21, wherein the first and second openings are separated by at least a portion of the compacting member and movement of the loaded portion of the application member from the first position to the second position causes the loaded portion of the application member to pass through the compacting member.

23. The device of claim 22, wherein the movement of the loaded portion from the first position to the second position includes rotation of the application member.

24. The device of claim 23, wherein the application member is rotatable about a pin oriented substantially perpendicular to the substantially circular cross-section of the application member.

25. The device of claim 1, wherein the compacting member comprises an element formed at least partially from a foam material.

26. The device of claim 25, wherein the foam material comprises cells chosen from closed-cells, open-cells, and semi-open cells.

27. The device of claim 26, wherein the foam material comprises an elastomer.

28. The device of claim 27, wherein the elastomer is chosen from a polyurethane and a polyether elastomer.

29. The device of claim 1, wherein the compacting member is mounted proximate a top portion of the reservoir.

30. The device of claim 1, wherein the compacting member defines a passage through which at least the portion of the application member is configured to pass.

31. The device of claim 30, wherein the passage is in the form of a slot.

32. The device of claim 30, wherein at least one edge defining the passage is substantially contiguous.

33. The device of claim 1, wherein the application member is provided on a wand.

34. The device of claim 33, wherein the application member is provided on a first end of the wand and a second end of the wand opposite to the first end of the wand is provided with a gripping element for holding the applicator.

35. The device of claim 33, wherein the reservoir defines an opening and the applicator is configured to be mounted on the reservoir, and wherein the gripping element is configured to seal the opening of the reservoir when the applicator is mounted on the reservoir.

36. The device of claim 35, wherein the portion of the application member to be loaded is disposed between the compacting member and a free surface of the composition in the reservoir when the applicator member is mounted on the reservoir.

37. The device of claim 36, wherein the wand passes through the compacting member when the applicator is mounted on the reservoir.

38. The device of claim 1, wherein the at least one fluid contained in the particles is chosen from water, polypropylene glycol, oils, gel, water-in-oil emulsion and oil-in-water emulsion.

39. The device of claim 1, wherein the particles containing the fluid are chosen from porous waxes, vesicles, microcapsules, microsponges, and microspheres.

40. The device of claim 39, wherein the walls of the microcapsules are made from a material chosen from epoxy, polyethylene, gelatin and polyester.

41. The device of claim 1, wherein the composition comprises at least one active agent.

42. The device of claim 41, wherein the active agent is chosen from antioxidants, free-radical scavengers, hydrating agents, humectants, UV screening agents, keratolytics, tanning accelerators, depigmenting agents, natural dyes, self-tanning agents, lipid regulators, anti-ageing agents, anti-wrinkle agents, anti-inflammatories, cicatrisants, bactericides, fungicides, insecticides, and skin conditioners.

43. The device of claim 1, wherein the particles containing the at least one fluid represent from approximately 1% to approximately 50% by weight of the composition.

44. The device of claim 1, wherein the particles containing the at least one fluid represent from approximately 2% to approximately 30% by weight of the composition.

45. The device of claim 1, wherein the particles containing the at least one fluid represent from approximately 5% to approximately 20% by weight of the composition.

46. A method of using the device of claim 1, comprising:

loading at least the portion of the application member with the composition contained in the reservoir;

moving the application member with respect to the reservoir so as to place at least the loaded portion in contact with at least a portion of the compacting member; and placing at least the loaded portion of the application member in contact with a surface to apply the composition to the surface.

47. The method of claim 46, causing the compacting member to exert pressure on at least the loaded portion of the application member.

48. The method of claim 47, wherein the pressure exerted on at least the loaded portion is sufficient to anchor the composition to the application member.

49. The method of claim 47, wherein the pressure exerted on at least the loaded portion is sufficient to compact the composition onto the application member.

50. The method of claim 47, wherein the pressure exerted on the loaded portion is sufficiently low so as to at least substantially limit the release of the at least one fluid from the particles.

51. The method of claim 47, wherein the placing of at least the loaded portion of the application member in contact with the surface comprises applying pressure to the loaded portion of the application member sufficient to release the fluid from the particles.

52. The method of claim 46, wherein the composition is a cosmetic product and the surface comprises at least one of skin, a nail, and hair.

53. The method of claim 46, wherein the loading comprises shaking the device.

54. The method of claim 46, wherein the moving comprises one of rotating and translating the application member.

55. The method of claim 46, wherein the moving comprises moving the application member with respect to the compacting member.

56. The method of claim 55, wherein a direction of relative movement between the application member and the compacting member is in a plane chosen from a plane of an application surface of the application member and a plane tangential to the application surface.

57. A device for dispensing a composition comprising particles containing at least one fluid, the device comprising:

a reservoir containing a composition comprising particles containing at least one fluid;

an application member having at least a portion configured to be loaded with the composition; and a compacting member configured to permit passage therethrough of at least the portion of the application member configured to be loaded with the composition, the compacting member being configured to exert pressure on at least the portion of the application member.

58. The device of claim 57, wherein the pressure exerted on the portion of the application member is sufficient to anchor the composition on the application member.

59. The device of claim 57, wherein the pressure exerted on the portion of the application member is sufficient to compact the composition onto the application member.

60. The device of claim 57, wherein the pressure exerted on the loaded portion of the application member is sufficiently low so as to at least substantially limit release of the at least one fluid contained in the particles.

61. The device of claim 57, wherein the particles containing the at least one fluid are chosen from one of porous structures and hollow structures.

62. The device of claim 61, wherein the particles are chosen from porous waxes, vesicles, microcapsules, nanocapsules, microsponges, and microspheres.

63. The device of claim 57, wherein the at least one fluid contained in the particles comprises a fluid chosen from water, polypropylene glycol, oils, gels, water-in oil emulsions, and oil-in-water emulsions.

64. The device of claim 57, wherein the particles containing the at least one fluid represent from approximately 1% to approximately 50% by weight of the composition.

65. The device of claim 57, wherein the particles containing the at least one fluid represent from approximately 2% to approximately 30% by weight of the composition.

66. The device of claim 57, wherein the particles containing the at least one fluid represent from approximately 5% to approximately 20% by weight of the composition.

67. The device of claim 57, wherein the portion of the application member moves relative to the compacting member during the passage of the portion through the compacting member.

68. The device of claim 67, wherein a direction of relative movement between the portion of the application member and the compacting member is in a plane chosen from a plane of an application surface of the application member and a plane tangential to the application surface.

69. The device of claim 57, wherein the composition contained in the reservoir further comprises at least one solid material.

70. The device of claim 69, wherein the solid material includes a pulverent material.

71. The device of claim 69, wherein the solid material is chosen from pigments, nacres, fillers, flakes, and mixtures thereof.

72. The device of claim 57, wherein the composition comprises liquid powder.

73. The device of claim 57, wherein the composition comprises a cosmetic product.

74. The device of claim 57, wherein the composition is configured to be applied to at least one of skin, nails and hair.

75. The device of claim 57, wherein the portion of the application member is configured to be loaded with the composition by shaking the reservoir.

76. The device of claim 57, wherein the compacting member defines a passage through which the portion of the application member is configured pass.

77. The device of claim 76, wherein the compacting member is formed at least partially from a foam material.

78. The device of claim 76, wherein the passage is in the form of a slot.

79. The device of claim 57, wherein the compacting member is disposed above a free surface of the composition contained in the reservoir.

80. The device of claim 79, wherein the portion of the application member is disposed between the free surface of the composition and the compacting member prior to loading the portion of the application member with the composition.

81. The device of claim 57, wherein the application member has a disk-like configuration.

82. The device of claim 57, wherein the application member is attached to a wand.

83. The device of claim 57, wherein at least part of the application member is made from a material chosen from an open-cell foam, a semi-open cell foam, a thermoplastic elastomer, a cured elastomer, a frit, and a felt.

84. The device of claim 57, wherein at least part of an application surface of the application member comprises flocking.

85. A method of dispensing a composition comprising particles containing at least one fluid, the method comprising:

providing an application member, a compacting member, and a reservoir containing a composition comprising particles containing at least one fluid;

loading at least a portion of the application member with the composition;

passing at least the loaded portion of the application member through the compacting member; and exerting pressure on at least the loaded portion of the application member with the compacting member.

86. The method of claim 85, wherein the exerting the pressure on the loaded portion includes exerting pressure sufficient to anchor the composition on the application member.

87. The method of claim 85, wherein the exerting the pressure includes exerting pressure sufficient to compact the composition on the application member.

88. The method of claim 85, wherein the exerting the pressure includes exerting pressure sufficiently low so as to at least substantially limit release of the fluid from the particles.

89. The method of claim 85, further comprising placing at least the loaded portion of the application member in contact with a surface to apply the composition to the surface.

90. The method of claim 89, wherein the placing includes exerting pressure on at least the loaded portion of the application member sufficient to release the at least one fluid from the particles.

91. The method of claim 89, wherein the placing includes placing at least the portion of the application member in contact with skin, nails, and hair.

92. The method of claim 85, wherein the loading comprises shaking the reservoir containing the composition.

93. The method of claim 85, wherein the composition comprises a cosmetic product.

94. The method of claim 93, wherein the composition comprises a liquid powder.

95. The method of claim 85, wherein the passing includes one of rotating the application member and translating the application member.

96. The method of claim 85, wherein the passing includes moving at least the portion of the application member and the compacting member relative to each other.

97. The method of claim 96, wherein a direction of relative movement of the portion of the application member and the compacting member is in a plane chosen from a plane of an application surface of the application member and a plane tangential to the application surface.

98. The method of claim 85, wherein the passing includes moving the loaded portion of the application member from a position within the reservoir to a position outside of the reservoir.

99. The method of claim 85, wherein the compacting member defines a passage and the passing includes passing the loaded portion through the passage.

100. The method of claim 85, wherein the particles containing the fluid are chosen from porous structures and hollow structures.

101. The method of claim 85, wherein the composition comprises at least one active agent for treating a surface to which the composition is to be applied.

102. A device for dispensing a composition comprising particles containing at least one fluid, the device comprising:

a reservoir containing a composition comprising particles containing at least one fluid;

an application member having at least a portion removably disposed within the reservoir, at least the portion being configured to be loaded with the composition; and a compacting member configured to exert pressure on at least the portion of the application member during removal of the portion of the application member from the reservoir.

103. The device of claim 102, wherein the pressure exerted on the portion of the application member is sufficient to anchor the composition on the application member.

104. The device of claim 102, wherein the pressure exerted on the portion of the application member is sufficient to compact the composition onto the application member.

105. The device of claim 102, wherein the pressure exerted on the portion of the application member is sufficiently low so as to at least substantially limit release of the at least one fluid contained in the particles.

106. The device of claim 102, wherein the particles containing the at least one fluid are chosen from one of porous structures and hollow structures.

107. The device of claim 106, wherein the particles are chosen from porous waxes, vesicles, microcapsules, nanocapsules, microsponges, and microspheres.

108. The device of claim 102, wherein the at least one fluid contained in the particles comprise a fluid chosen from water, polypropylene glycol, oil, gel, water-in oil emulsions, and oil-in-water emulsions.

109. The device of claim 102, wherein the particles containing the at least one fluid represent from approximately 1% to approximately 50% by weight of the composition.

110. The device of claim 102, wherein the particles containing the at least one fluid represent from approximately 2% to approximately 30% by weight of the composition.

111. The device of claim 102, wherein the particles containing the at least one fluid represent from approximately 5% to approximately 20% by weight of the composition.

112. The device of 102, wherein the portion of the application member moves relative to the compacting member during the removal of the portion from the reservoir.

113. The device of claim 112, wherein a direction of relative movement between the portion of the application member and the compacting member is in a plane chosen from a plane of an application surface of the application member and a plane tangential to the application surface.

114. The device of claim 112, wherein the portion of the application member passes through at least a portion of the compacting member during the removal of the portion from the reservoir.

115. The device of claim 102, wherein the composition contained in the reservoir further comprises at least one solid material.

116. The device of claim 115, wherein the solid material includes a pulverent material.

117. The device of claim 115, wherein the solid material is chosen from pigments, nacres, fillers, flakes, and mixtures thereof.

118. The device of claim 102, wherein the composition comprises liquid powder.

119. The device of claim 102, wherein the composition comprises a cosmetic product.

120. The device of claim 102, wherein the composition is configured to be applied to at least one of the skin, nails and hair.

121. The device of claim 102, wherein the portion of the application member is configured to be loaded with the composition by shaking the device.

122. The device of claim 102, wherein the compacting member defines a passage through which the portion of the application member is configured to pass during removal of the portion of the application member from the reservoir.

123. The device of claim 122, wherein the compacting member is formed at least partially from a foam material.

124. The device of claim 122, wherein the passage is in the form of a slot through which the portion of the application member is configured to rotate.

125. The device of claim 102, wherein the compacting member is disposed above a free surface of the composition contained in the reservoir.

126. The device of claim 125, wherein the portion of the application member is disposed between the free surface of the composition and the compacting member when the portion of the application member is disposed in the reservoir.

127. The device of claim 102, wherein the application member has a disk-like configuration.

128. The device of claim 102, wherein the application member is attached to a wand.

129. The device of claim 102, wherein at least part of the application member is made from a material chosen from an open-cell foam, a semi-open cell foam, a thermoplastic elastomer, a cured elastomer, a frit, and a felt.

130. The device of claim 102, wherein at least part of an application surface of the application member comprises flocking.

131. A method of dispensing a composition comprising particles containing at least one fluid, the method comprising:

providing a reservoir containing a composition comprising particles containing at least one fluid, an application member having at least a portion removably disposed in the reservoir, and a compacting member;

loading at least the portion of the application member with the composition;

removing at least the loaded portion of the application member from the reservoir; and exerting pressure on the loaded portion of the application member with the compacting member during removal of the portion of the application member from the reservoir.

132. The method of claim 131, wherein the exerting the pressure on the loaded portion includes exerting pressure sufficient to anchor the composition on the application member.

133. The method of claim 131, wherein the exerting the pressure on the loaded portion includes exerting pressure sufficient to compact the composition on the application member.

134. The method of claim 131, wherein the exerting the pressure includes exerting pressure sufficiently low so as to at least substantially limit release of the at least one fluid from the particles.

135. The method of claim 131, further comprising placing at least the loaded portion of the application member in contact with a surface to apply the composition to the surface.

136. The method of claim 135, wherein the placing includes exerting pressure on at least the loaded portion of the application member sufficient to release the at least one fluid from the particles.

137. The method of claim 135, wherein the placing includes placing at least the portion of the application member in contact with one of skin, nails, and hair.

138. The method of claim 131, wherein the loading comprises shaking the reservoir containing the composition.

139. The method of claim 131, wherein the composition comprises a cosmetic product.

140. The method of claim 139, wherein the composition comprises a liquid powder.

141. The method of claim 131, wherein the removing includes one of rotating the application member and translating the application member.

142. The method of claim 141, wherein the application member has a disk-like configuration and the removing include rotating the application member.

143. The method of claim 131, wherein the removing includes moving the application member and the compacting member relative to each other.

144. The method of claim 143, wherein a direction of relative movement of the loaded portion of the application member and the compacting member is in a plane chosen from a plane of an application surface of the application member and a plane tangential to the application surface.

145. The method of claim 143, wherein the removing includes passing the portion of the application member through at least a portion of the compacting member.

146. The method of claim 131, wherein the compacting member defines a passage and the passing includes passing the portion through the passage.

147. The method of claim 131, wherein the particles containing the fluid are chosen from porous structures and hollow structures.

148. The method of claim 131, wherein the composition comprises at least one active agent for treating a surface to which the composition is to be applied.

* * * * *

UNITED STATES PATENT AND TRADEMARK OFFICE

CERTIFICATE OF CORRECTION

PATENT NO. : 6,682,244 B2
DATED : January 27, 2004
INVENTOR(S) : Jean-Louis H. Gueret It is certified that error appears in the above-identified patent and that said Letters Patent is hereby corrected as shown below:

Column 14,
Line 20, replace “claim 33,” with -- claim 34, --;

Column 15,
Line 66, replace “water-in oil” with -- water-in-oil --;

Column 16,
Line 38, replace “pass” with -- to pass --;

Column 18,
Line 18, replace “water-in oil” with -- water-in-oil --;
Line 32, replace “of 102,” with -- of claim 102, --; and Column 20,
Line 26, replace “include” with -- includes --.

Signed and Sealed this

Twenty-fifth Day of May, 2004

JON W. DUDAS
*Acting Director of the United States Patent and Trademark Office*